US005815951A

United States Patent [19]

Jordan

[11] Patent Number: 5,815,951

[45] **Date of Patent: *Oct. 6, 1998**

[54] ATHLETIC SHOE WITH RETRACTABLE SPIKES

[76] Inventor: J. Charles Jordan, 1401 Plumstead Rd., Charlotte, N.C. 28216

[ * ] Notice: The term of this patent shall not extend beyond the expiration date of Pat. No. 5,526,589.

[21] Appl. No.: 616,427

[22] Filed: Mar. 15, 1996

Related U.S. Application Data

[63] Continuation of Ser. No. 396,658, Mar. 1, 1995, Pat. No. 5,526,589.

[51] Int. Cl.[6] ..... A43B 5/00; A43C 15/00

[52] U.S. Cl. ..... 36/61; 36/134; 36/59 R; 36/67 R; 36/29

[58] Field of Search ..... 36/59 R, 67 D, 36/67 R, 61, 134, 127, 29, 35 B

[56] References Cited

U.S. PATENT DOCUMENTS

| | | | |
|---|---|---|---|
| 3,343,283 | 9/1967 | Henry et al. | 36/61 |
| 3,747,238 | 7/1973 | Jankauskas | 36/61 |
| 3,793,751 | 2/1974 | Gordos | 36/61 |
| 4,226,032 | 10/1980 | Herro | 36/127 |
| 4,271,608 | 6/1981 | Tomuro | 36/61 |
| 4,375,729 | 3/1983 | Buchanen, III | 36/59 R |
| 4,821,434 | 4/1989 | Chein | 36/134 |
| 4,825,562 | 5/1989 | Chuang | 36/134 |
| 4,873,774 | 10/1989 | Lafever | 36/61 |
| 5,113,599 | 5/1992 | Cohen et al. | 36/88 |
| 5,158,767 | 10/1992 | Cohen | 36/88 |
| 5,289,647 | 3/1994 | Mercer | 36/134 |
| 5,299,369 | 4/1994 | Goldman | 36/127 |
| 5,526,589 | 6/1996 | Jordan | 36/61 |

*Primary Examiner*—M. D. Patterson
*Attorney, Agent, or Firm*—Adams Law Firm, P.A.

[57] ABSTRACT

An athletic shoe including a shoe upper and an outsole connected to the shoe upper is provided. The outsole defines a plurality of spike receiving openings therein. A plate is located between the shoe upper and the outsole, and includes a plurality of spikes attached thereto. The plate is movable within the upper between a spike-exposing position whereby the plurality of spikes extend outwardly through respective openings formed in the outsole, and a spike-retracting position. An inflatable bladder is located between the plate and the outsole. When inflated with a fluid, the bladder lifts the plate upwardly into the spike-retracting position, and holds the plate in the spike-retracting position during shoe wear. An exhaust communicates with the bladder for exhausting the fluid contained in the bladder. When the fluid is exhausted, the plate is movable into the spike-exposing position by the weight of the wearer during shoe wear.

8 Claims, 4 Drawing Sheets

ATHLETIC SHOE WITH RETRACTABLE SPIKES

This application is a continuation application of U.S. Ser. No. 08/396,658, filed Mar. 1, 1995, now U.S. Pat. No. 5,526,589.

TECHNICAL FIELD AND BACKGROUND OF THE INVENTION

This invention relates to an athletic shoe with retractable spikes. The invention is most applicable for use by golfers, although other application to sports and events using spiked shoes is foreseeable. For example, the shoe may be used for baseball, football, hiking, and the like. The invention includes means readily operable by the wearer for lifting the spikes into a retracted position within the shoe and for lowering the spikes into a spike-exposing position. It is generally desirable to retain the spikes in the retracted position when wearing the shoes on hard surfaces or easily damaged surfaces, such as parking lots, side walks, wooden floors, or club house floors.

Conventional spiked golf shoes suffer from drawbacks and limitations. Since the spikes are fixed directly to the outsole of the shoe, they are in constant contact with the ground surface during wear. This causes excessive wear on the spikes as the shoes are worn in areas off the golf course, and often results in slip-and-fall accidents and injury. Moreover, the exposed spikes can cause substantial damage to the putting greens of the golf course and to the floor of the club house. As a result, there exists a need for a spiked athletic shoe wherein the spikes can be quickly and easily moved and retained in a retracted position within the shoe during wear.

According to one spiked golf shoe disclosed in U.S. Pat. No. 4,271,608, a number of spikes are fixed to the inner sole of the shoe, and are urged upwardly into a retracted position within the shoe by a resilient sponge material positioned between the inner sole and the outer sole of the shoe. The outer sole of the shoe includes a corresponding number of holes for receiving the spikes as they move downwardly from the retracted position into an exposed position. As a wearer steps, his body weight compresses the sponge material and forces the spikes downwardly into the exposed position and into direct contact with the ground surface. When the wearer's foot is lifted from the ground, the spikes are again urged upwardly into the retracted position by the sponge material.

Although the '608 patent addresses the need for a golf shoe with retractable spikes, it does not provide means for holding the spikes in the retracted position during shoe wear, and thus does not solve the problems associated with conventional spiked golf shoes. Instead, the primary object of the '608 patent is to provide a golf shoe which cleans away dirt from an area surrounding the spikes as the spikes retract within the shoe.

SUMMARY OF THE INVENTION

Therefore, it is an object of the invention to provide a spiked athletic shoe wherein the spikes are easily movable by the wearer between a spike-exposing position and a retracted position within the shoe.

It is another object of the invention to provide a spiked athletic shoe wherein the spikes may be comfortably retained in the retracted position during shoe wear.

It is another object of the invention to provide a spiked athletic shoe which will not damage golf greens or club house floors during shoe wear.

It is another object of the invention to provide a spiked athletic shoe which can be worn on hard surfaces without an increased risk of accidents and injury.

It is another object of the invention to provide a spiked athletic shoe wherein the spikes are readily removable and replaceable using a conventional tool.

It is another object of the invention to provide a spiked athletic shoe which uses conventional spikes.

It is another object of the invention to provide a spiked athletic shoe including parts which are easily removed from inside the shoe for repair or replacement as required.

It is another object of the invention to provide a spiked athletic shoe which is comfortable and durable.

These and other objects of the present invention are achieved in the preferred embodiments disclosed below by providing an athletic shoe including a shoe upper and an outsole connected to the shoe upper. The outsole defines a plurality of spike receiving openings therein.

Plate means is located between the shoe upper and the outsole, and includes a plurality of spikes attached thereto. The plate means is movable within the upper between a spike-exposing position whereby the plurality of spikes extend outwardly from the outsole, and a spike-retracting position.

An inflatable bladder is located between the plate means and the outsole. When inflated with a fluid, the bladder lifts the plate means upwardly into the spike-retracting position, and holds the plate means in the spike-retracting position during shoe wear.

Exhaust means communicates with the bladder for exhausting the fluid contained in the bladder. When the fluid is exhausted, the plate means is movable into the spike-exposing position by the weight of the wearer during shoe wear.

According to one preferred embodiment of the invention, a pump is mounted on an outside surface of the upper. The pump includes an inlet for receiving fluid to be injected into the bladder, and an outlet communicating with the bladder for directing the fluid from the pump into the bladder.

According to another preferred embodiment of the invention, the inlet includes an inlet check valve for allowing one-way fluid flow into the pump. The inlet check valve prevents the escape of fluid outwardly through the inlet.

According to yet another preferred embodiment of the invention, the outlet includes an outlet check valve for allowing one-way fluid flow from the pump and into the bladder. The outlet check valve prevents the escape of fluid outwardly from the bladder.

According to yet another preferred embodiment of the invention, the exhaust means includes an exhaust tube extending outwardly from the bladder for directing the exhausted fluid to the atmosphere.

According to yet another preferred embodiment of the invention, the exhaust tube includes an exhaust valve for controlling the release of fluid from the bladder.

According to yet another preferred embodiment of the invention, the plate means includes a plurality of internally-threaded holes for receiving the plurality of spikes. Each of the plurality of spikes includes a complementary-threaded end portion for mating with the thread of the holes to removably attach the plurality of spikes to the plate means.

According to yet another preferred embodiment of the invention, an inner sole is located adjacent to the plate means for residing between the plate means and the foot of the wearer during shoe wear.

BRIEF DESCRIPTION OF THE DRAWINGS

Some of the objects of the invention have been set forth above. Other objects and advantages of the invention will appear as the invention proceeds when taken in conjunction with the following drawings, in which.

DESCRIPTION OF THE PREFERRED EMBODIMENT AND BEST MODE

Figure 1:
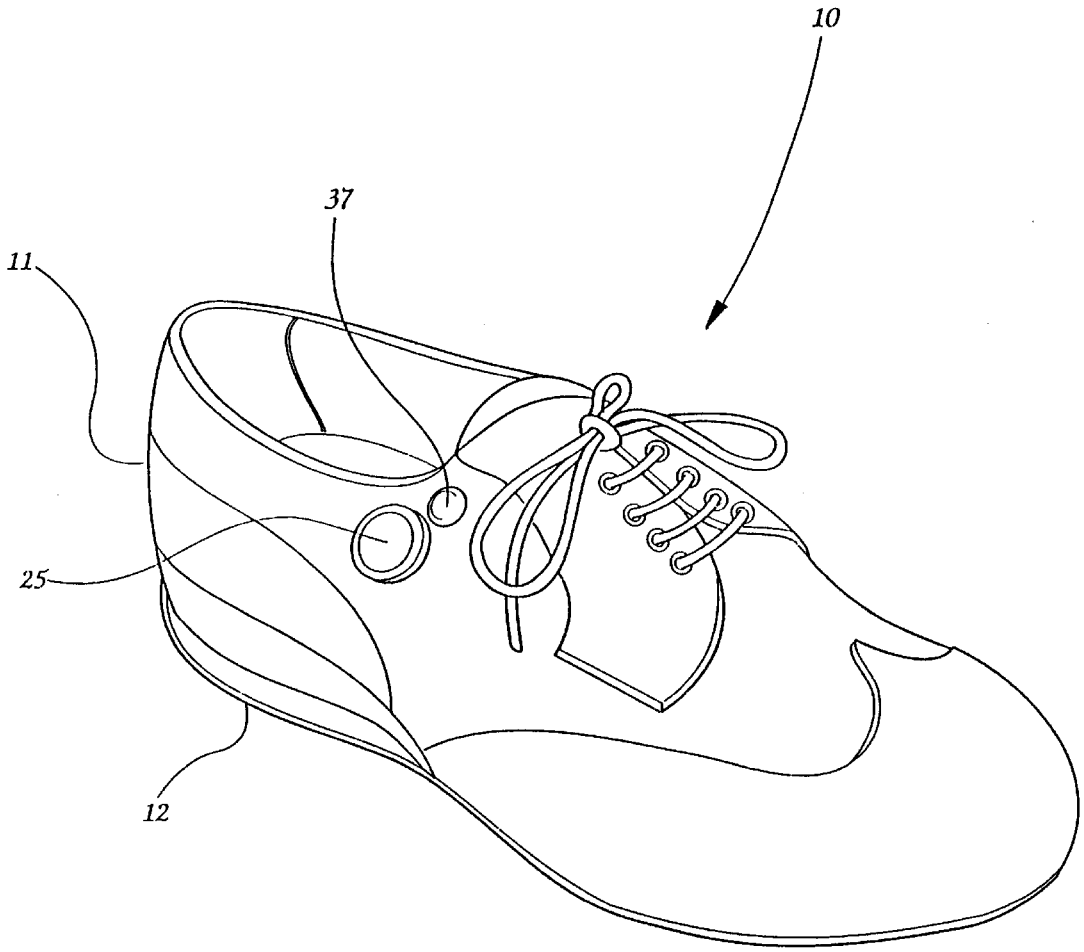
FIG. 1 is a perspective view of a spiked athletic shoe according to one preferred embodiment of the invention.

Referring now specifically to the drawings, an athletic shoe with retractable spikes according to the present invention is illustrated in FIG. 1 and shown generally at reference numeral 10. The athletic shoe 10 is most applicable for use by golfers, although other application to sports and events using spiked shoes is foreseeable. For example, the athletic shoe 10 may be used for baseball, football, hiking, or the like.

Figure 2:
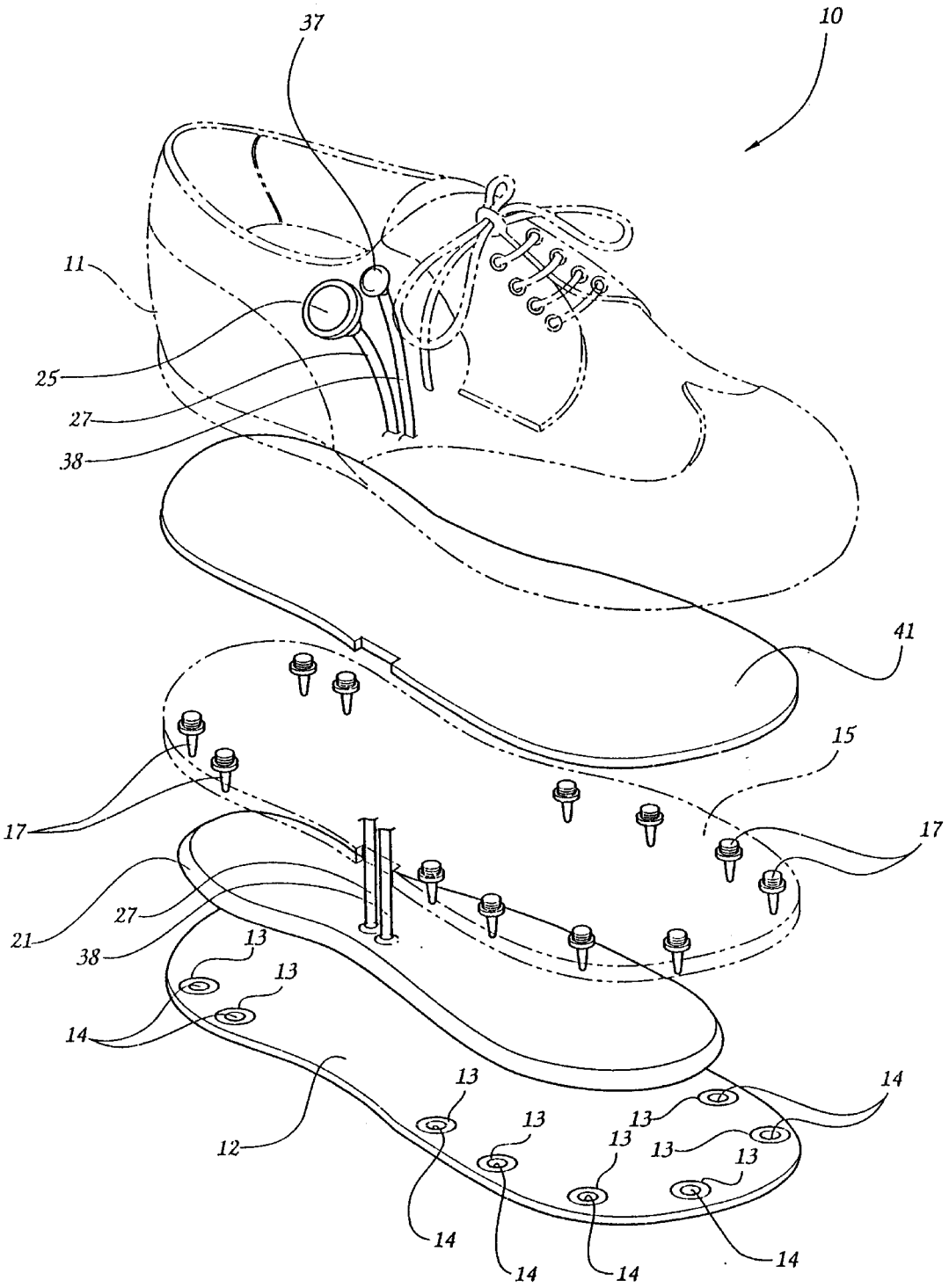
FIG. 2 is an exploded view of the shoe shown in FIG. 1, and illustrating the interior elements of the shoe with the spike plate and shoe upper shown in phantom.

As best shown in FIGS. 1 and 2, the athletic shoe 10 is formed of a shoe upper 11, and an outsole 12. The outsole 12 is connected to the shoe upper 11 using any suitable means known in the art, such as by sew stitches or heat sealing. The outsole 12 is preferably constructed of a relatively thin, durable rubber or flexible plastic material with several spike-receiving holes 14 formed along a perimeter portion of the outsole 12. The holes 14 may be reinforced with metal grommets 13. In one embodiment, the outsole 12 is about one-eighth of an inch thick.

A spike plate 15 is located between the shoe upper 11 and the outsole 12, and includes several removable spikes 17 attached around a perimeter portion of the spike plate 15 and in vertical registration with the holes 14 of the outsole 12. The spike plate 15 is preferably formed of a durable plastic material or leather having sufficient flexibility to cooperate with other sole components of the shoe 10 during wear. The spikes 17 are conventional spikes which include a threaded end portion for being mated with respective complementary threaded openings formed in the spike plate 15. The holes 14 in the outsole 12 have a sufficient diameter for allowing a wearer to remove and replace the spikes 17 using a conventional tool.

An inflatable bladder 21 is positioned between the spike plate 15 and the outsole 12 of the shoe 10 for being inflated with a fluid, such as air. According to one embodiment, the bladder 21 covers about 80–90% of the surface area of the spike plate 15 when inflated.

Figure 4:
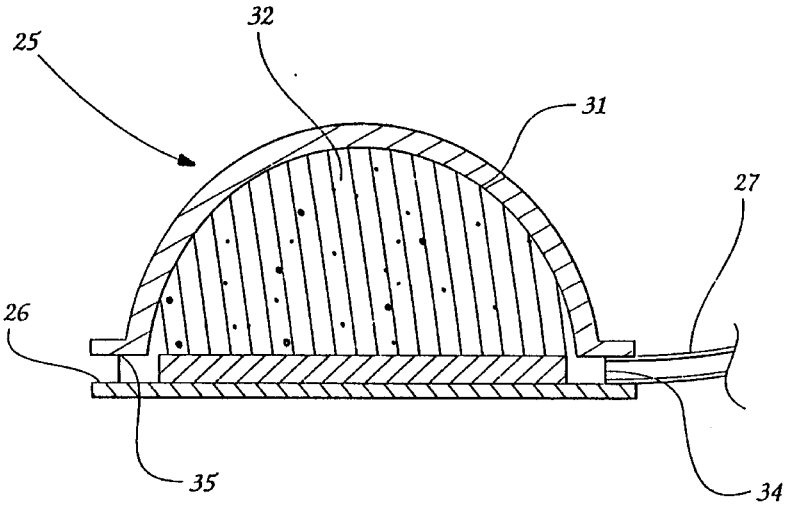
FIG. 4 is an enlarged vertical cross-sectional view of the pump used for inflating the bladder.

A pump 25 is preferably located on an outside surface of the shoe upper 11, and is operable by the wearer for inflating the bladder 21 with air. As best shown in FIG. 4, the pump 25 includes an inlet 26, and an outlet tube 27 fluidly communicating with the bladder 21. Examples of a suitable pump 25 and bladder 21 are described in U.S. Pat. Nos. 5,113,599 and 5,158,767 issued to Reebok International Ltd. of Stoughton, Mass. The disclosures of each of these patents are incorporated herein by reference.

In an alternative embodiment, a separate compressed-air or gas container (not shown) may be used instead of the pump 25 for inflating the bladder 21. The container includes a hose and injection nozzle which is inserted directly into the outlet tube fluidly communicating with the bladder. The compressed air or gas is passed from the injection nozzle, through the outlet tube, and into the bladder to inflate the bladder, as desired.

Figure 3:
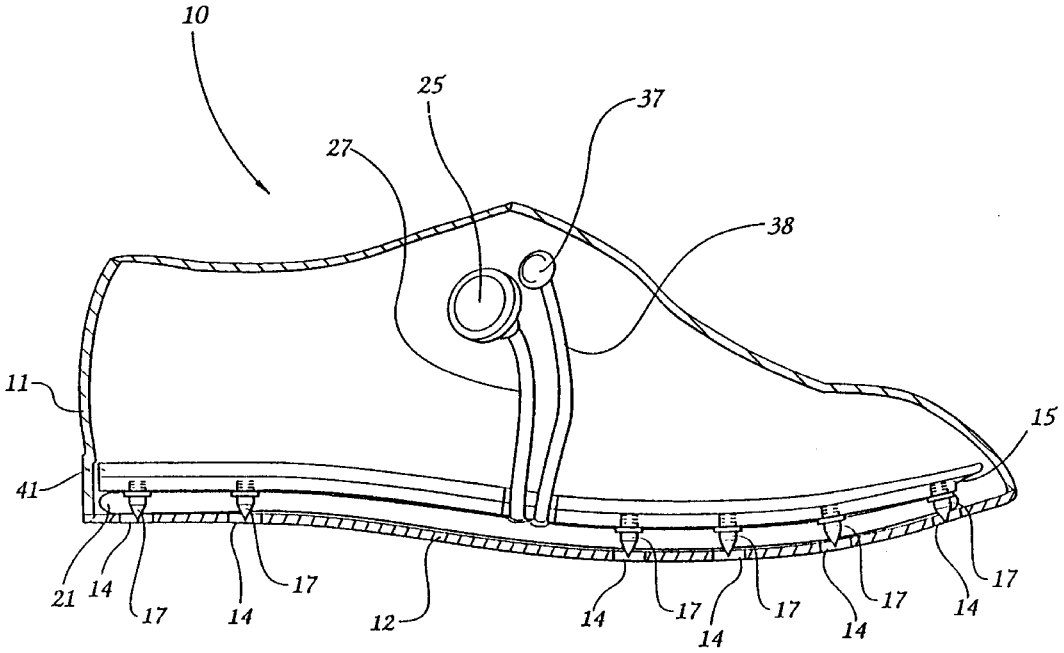
FIG. 3 is a lengthwise vertical cross-sectional view of the shoe, and showing the spike plate in a retracted position with the bladder inflated with a fluid.

Referring to FIG. 3, as the bladder 21 is inflated with air, it lifts the spike plate 15 upwardly into a spike-retracting position, and holds the spike plate 15 in this position during shoe wear. The spikes 17 are recessed within the shoe 10, and do not engage the ground surface during shoe wear. This is especially desirable for protecting delicate surfaces, such as club house floors and golf greens, from damage generally caused by the spikes 17.

Figure 5:
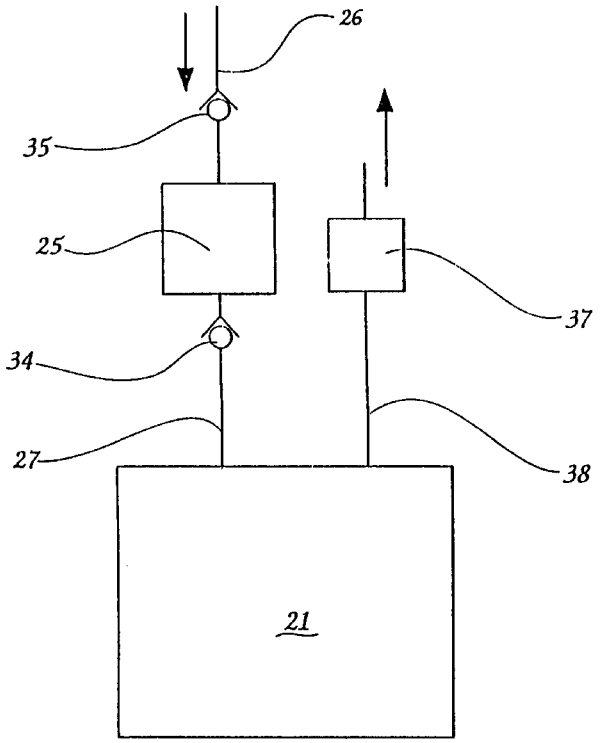
FIG. 5 is a schematic illustrating the operation of the pump for inflating the bladder.

Operation of the pump 25 is illustrated in FIGS. 4 and 5. The pump 25 preferably includes a flexible outer rubber skin 31 and a resilient foam insert 32 positioned within the skin 31. The foam insert 32 is a porous material which, in a normal state, defines a volume for storing air. As the wearer depresses the pump 25, the foam insert 32 is flattened. The existing air stored in the pump 25 is forced through the outlet tube 27 and into the bladder 21. An outlet check valve 34 provides one-way air flow from the pump 25 into the bladder 21, and prevents the escape of air outwardly from the bladder 21.

As the foam insert 32 retakes its shape after being depressed, air is drawn inwardly from the atmosphere through the inlet 26 and back into the pump 25 for storage. An inlet check valve 35 located at the inlet 26 provides one-way air flow from the atmosphere into the pump 25, and prevents the escape of air outwardly through the inlet 26. The pump 25 is repeatedly depressed by the wearer until the bladder 21 is sufficiently inflated. Suitable examples of the outlet and inlet check valves 34 and 35 are those manufactured by Air Logic of Racine, Wis., and sold as model #2804-401.

To deflate the bladder 21, the wearer depresses an exhaust valve button 37 located on the outside surface of the shoe upper 11. The exhaust valve button 37 causes the release of air from the bladder 21, through an exhaust tube 38, and into the atmosphere.

Figure 6:
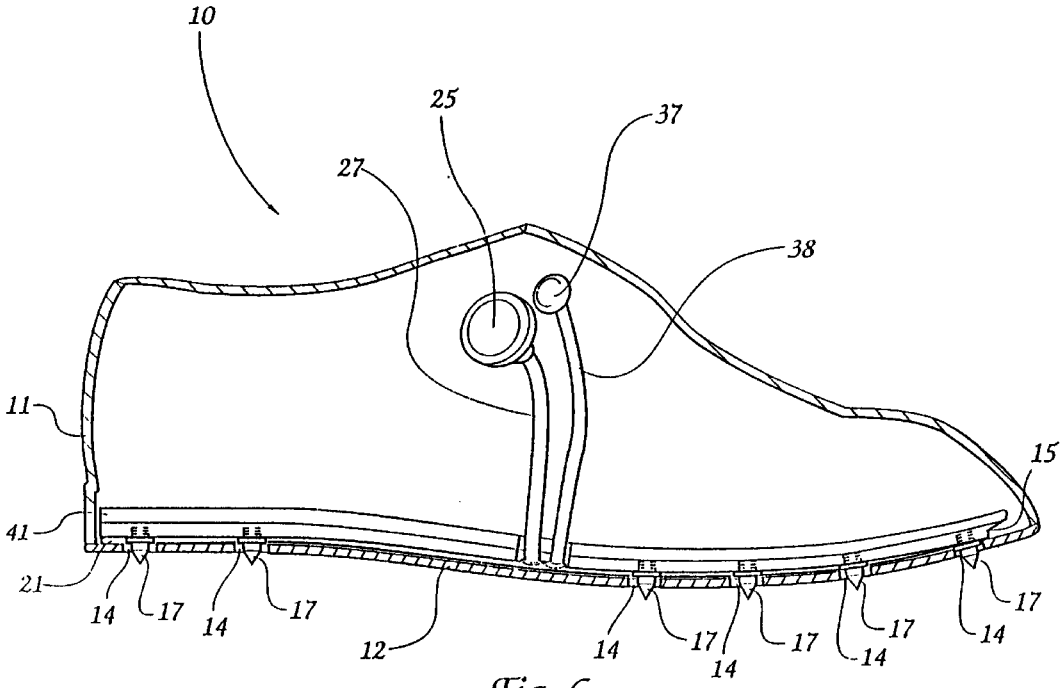
FIG. 6 is a lengthwise vertical cross-sectional view of the shoe, and showing the spike plate in a spike-exposing position with the bladder deflated.

When the bladder 21 is deflated, the spike plate 15 is movable downwardly by the weight of the wearer into a spike-exposing position, as shown in FIG. 6. In this position, the spikes 17 extend outwardly from the outsole 12 and engage the ground surface. In an alternative embodiment, locking means (not shown) may be provided for maintaining the spike plate in the spike-exposing position.

In addition, for added comfort to the wearer, a cushioned inner sole 41 may be located adjacent to a top surface of the spike plate 15 for residing between the spike plate 15 and the foot of the wearer during shoe wear. Preferably, the inner sole 41, spike plate 15, and bladder 21 may all be easily removed from inside of the shoe 10 for repair or replacement, as required.

In yet another embodiment of the athletic shoe (not shown), the bladder is positioned on the opposite side of the spike plate between the inner sole and spike plate. When inflated, the bladder urges the spike plate downwardly into the spike-exposing position. Biasing means located between the outsole of the shoe and spike plate acts to normally urge the spike plate upwardly into the spike-retracting position during shoe wear. Holding means maintains the spike plate in the retracted position until moved downwardly by the inflated bladder.

An athletic shoe with retractable spikes is described above. Various details of the invention may be changed without departing from its scope. Furthermore, the foregoing description of the preferred embodiment of the invention is provided for the purpose of illustration only and not for the purpose of limitation—the invention being defined by the claims.

I claim:

1. An athletic shoe, comprising:

(a) a shoe upper;

(b) an outsole connected to the shoe upper, and comprising a bottom wall defining a plurality of spike receiving openings therein;

(c) a flexible spike plate located between the shoe upper and the bottom wall of said outsole for carrying a plurality of outward extending spikes, said spike plate extending longitudinally and continuously from a heel area to a toe area of the shoe and being movable within said upper between a spike-exposing position whereby said plurality of spikes extend outwardly from said outsole, and a spike-retracting position;

(d) an inflatable bladder engaging said spike plate in the heel area and the toe area of the shoe, and being inflatable with a fluid to move said spike plate within said upper from one of said spike-exposing and spike-retracting positions to the other of said spike-exposing and spike-retracting positions; and (e) exhaust means communicating with said bladder for exhausting the fluid contained in said bladder.

2. An athletic shoe according to claim 1, and including a pump mounted on an outside surface of said upper, and including an inlet for receiving fluid to be injected into said bladder, and an outlet communicating with said bladder for directing the fluid from said pump into said bladder.

3. An athletic shoe according to claim 2, wherein said inlet includes an inlet check valve for allowing one-way fluid flow into said pump, and preventing the escape of fluid outwardly through said inlet.

4. An athletic shoe according to claim 2, wherein said outlet includes an outlet check valve for allowing one-way fluid flow from said pump and into said bladder, and preventing the escape of fluid outwardly from said bladder.

5. An athletic shoe according to claim 1, wherein said exhaust means includes an exhaust tube extending outwardly from said bladder for directing the exhausted fluid into the atmosphere.

6. An athletic shoe according to claim 5, wherein said exhaust tube includes an exhaust valve for controlling the release of fluid from said bladder.

7. An athletic shoe according to claim 1, wherein said spike plate includes a plurality of internally-threaded holes for receiving said plurality of spikes, each of said plurality of spikes including a complementary-threaded end portion for mating with the thread of said holes to removably attach said plurality of spikes to said spike plate.

8. An athletic shoe according to claim 1, and including an inner sole located adjacent to said spike plate for residing between said spike plate and the foot of the wearer during shoe wear.

* * * * *